US006418976B2

(12) United States Patent
Loehr et al.

(10) Patent No.: US 6,418,976 B2
(45) Date of Patent: Jul. 16, 2002

(54) THREAD BRAKE SYSTEM WITH A LINEAR ELECTRIC MOTOR FOR WEAVING LOOMS

(75) Inventors: Heinz-Peter Loehr, Maria-Thann; Rainer Schuster, Lindau, both of (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/810,290

(22) Filed: Mar. 16, 2001

(30) Foreign Application Priority Data

Mar. 18, 2000 (DE) ..... 100 13 625

(51) Int. Cl.[7] ..... D03D 47/34
(52) U.S. Cl. ..... 139/450; 139/194
(58) Field of Search ..... 139/194, 450

(56) References Cited

U.S. PATENT DOCUMENTS

| | | | | |
|---|---|---|---|---|
| 4,641,688 A | | 2/1987 | Gehring | |
| 5,179,980 A | | 1/1993 | Hubner et al. | |
| 5,305,966 A | | 4/1994 | Motta | |
| 5,398,731 A | | 3/1995 | Schuster | |
| 5,417,251 A | * | 5/1995 | Josefsson et al. | 139/450 |
| 5,476,122 A | | 12/1995 | Schuster et al. | |
| 5,492,286 A | | 2/1996 | Motta | |
| 5,553,641 A | | 9/1996 | Zenoni | |
| 6,006,795 A | * | 12/1999 | Corain et al. | 139/453 |
| 6,026,864 A | * | 2/2000 | Corain et al. | 139/449 |

FOREIGN PATENT DOCUMENTS

| | | |
|---|---|---|
| DE | 3446567 | 5/1986 |
| DE | 4306911 | 12/1993 |
| DE | 4323748 | 7/1994 |
| DE | 69514069 | 4/2000 |
| EP | 0467059 | 1/1992 |
| EP | 0475892 | 3/1992 |
| EP | 0524429 | 1/1993 |
| EP | 0597239 | 5/1994 |

* cited by examiner

*Primary Examiner*—Andy Falik
(74) *Attorney, Agent, or Firm*—W. F. Fasse; W. G. Fasse

(57) ABSTRACT

At least one of two flexible leaf springs that form a thread gap is controlled by a linearly moveable element of a linear motor or drive. Multi-thread brakes are formed by assembling a plurality of such brakes on a common support whereby a single stator may cooperate with a plurality of linearly moveable armatures forming a corresponding plurality of thread brakes or each thread brake may have its own stator and its own armature arranged in a row either linearly or along a curved support, whereby a compact structure is achieved.

9 Claims, 4 Drawing Sheets

FIG.1

THREAD BRAKE SYSTEM WITH A LINEAR ELECTRIC MOTOR FOR WEAVING LOOMS

PRIORITY CLAIM

This application is based on and claims the priority under 35 U.S.C. §119 of German Patent Application 100 13 625.7, filed on Mar. 18, 2000, the entire disclosure of which is incorporated herein by reference.

FIELD OF THE INVENTION

The invention relates to a thread brake for weaving looms, particularly weft thread brakes for controlling the weft tension.

BACKGROUND INFORMATION

Thread brakes for textile yarns are well known in the art. Such brakes are for example used for controlling the weft thread tension in a weaving loom. Many different thread brake constructions are currently in use.

German patent publication DE 34 46 567 C1 shows a weft thread brake with a controllable braking action. The known brake according to said publication comprises two elastic elements forming lamella which face each other to form a weft thread passage or gap. Electromagnetic control means are provided for adjusting or controlling the position of at least one of the lamella or elastic element to thereby control the braking force that is applied to the weft thread passing through the passage between the lamella.

German patent publication DE 43 06 911 C1 discloses a weft thread brake that also uses lamella type elements for forming the thread passage. The position of at least one of the lamella is variable by a stepping motor which controls the pressure applied to one of the lamella by an eccentric cam mounted to the rotating shaft of the stepping motor.

Another weft thread brake is disclosed in German patent publication DE 43 06 911 C1 and German patent publication DE 43 23 748 C1 discloses an improvement of the weft thread brake disclosed in the first mentioned German patent publication DE 43 06 911 C1. The improvement resides in an arrangement of a thread tension sensor positioned down stream of the weft thread brake as viewed in the direction of the weft thread motion. The output signal of the sensor is used for controlling the brake force applied by the weft brake to the weft thread as a function of the weft thread tension in a closed loop control.

A multitude of other thread brakes have become known. For example European patent publication EP 0 475 892 A1 discloses a brake belt cooperating with a controllable brake body arranged relative to the brake belt so that the weft thread end passes through between the belt and the body. European patent publication EP 0 467 059 A1 discloses a so-called looping angle brake. Such brakes control the braking force by varying the looping angle of the weft thread around a brake element.

European patent publications EP 0 524 429 A1 and EP 0 597 239 A1 disclose weft thread brakes that do not use two elastic elements that bare against one another in a spring-elastic manner. In this conventional construction of a weft brake, the lamella or elastic elements have been replaced by one spring element cooperating with a counter bearing member of rotational symmetry. The counter bearing member has the shape of a cam that has a circumference with at least one sector having a reduced diameter. The counter bearing member is mounted on the rotational shaft of an electric stepping motor.

German patent publication DE 695 14 069 T2 discloses a device for positively modulating the brake force applied to the weft thread supplied by a weft thread supply mechanism in the form of a supply drum. A stepping motor carrying a thread motion control lever on its shaft is arranged downstream of the thread supply drum in such a way that the weft thread is deflected more or less as the control lever rotates with its shaft.

It is a disadvantage of known electrically controllable weft thread brakes that they all have a substantial structural size which is inconvenient for installation in a loom, particularly where a plurality of such weft brakes must be mounted in a space that is relatively small, for instance when a plurality of weft threads having different colors must be supplied to the weft insertion device of the loom. The supply of a plurality of weft threads having different colors requires the arrangement of a respective plurality of weft brakes which in turn require the positioning of thread guides for leading the peripherally outer yarns to the weft insertion point. Leading the weft yarns over or through these thread guides exposes these outer yarns to a higher tension load than the tension load to which yarns positioned in the center of the thread supply. Further, as the RPM of the main loom drive shaft is increased, it becomes additionally necessary that the thread brakes work extremely fast and permit nevertheless the maintaining of a substantially constant weft thread tension in which tension changes are negligibly small during the several weft insertion phases. These requirements cannot be satisfactorily met at all times by conventional weft thread brakes.

OBJECTS OF THE INVENTION

In view of the above it is the aim of the invention to achieve the following objects singly or in combination:

- to construct a thread brake particularly a weft thread brake in such a manner that is compact, and capable of a rapid reaction with precision and reliability;
- to construct a weft brake for a plurality of weft threads whereby the thread tension shall be individually controllable for each weft thread or group of weft threads so that all weft thread of a group will have the same tension regardless of the position of the individual weft thread on its way to the weft insertion; and
- to construct the weft brake for a plurality of weft threads in such a way that a convenient weft presentation for the weft insertion into the loom shed is achieved.

SUMMARY OF THE INVENTION

The thread brake according to the invention is characterized by at least one pair of two flexible elements such as lamella having a leaf spring characteristic that face each other or bear against each other to form a thread gap for passing a thread through the gap wherein the gap width is controlled by at least one controller in the form of a linear motor having a stator and a linearly moving member such as an armature or a pneumatic piston which is positioned for operatively influencing at least one of the flexible elements for adjusting the thread gap width.

The drive of the thread brake or rather the control of the weft tension by the operation of the weft brake by a linear motor permits a very compact construction which is capable of a rapid reaction and precise operation.

In a preferred embodiment, the linear motor comprises at least one stator and at least one linearly moving member that is effective with its free end on at least one of the two lamella forming a pair. In a preferred embodiment, the linear motor is an electrical, linear stepping motor or linear servo motor. However, it is also possible to use, for example, a pneumatically driven linear motor which is quite feasible in an air jet weaving loom where a source of pneumatic pressure is readily available.

The linearly movable member of the linear motor is effective with its free end on the lamella or at least one lamella of a pair of such lamella either directly or through an adjustment pin. Whether or not an adjustment pin is provided between the free end of the linearly movable member and the respective lamella depends on the structural requirements of the individual loom, particularly how the linear motor is to be arranged relative to the lamella.

If a loom uses a plurality of weft threads, for example of different colors, it is necessary to arrange several weft thread brakes as a multi-weft brake, so that each weft thread has its own brake. According to the invention the multi-thread brake preferably has a single fixed stator which cooperates with a plurality of linearly moveable members such as armatures, one of which is provided for each weft thread. In a multi-weft or multi-thread brake according to the invention, the individual armatures are arranged either along a linear row or along a curved path next to one another.

Preferably, the control of the linear motor, more specifically the control of the individual motion of the linearly moveable members of the linear motor, is derived directly from the central loom control. In a multi-weft brake, each linearly moveable member is individually controllable even though the multi-brake has only one stator.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
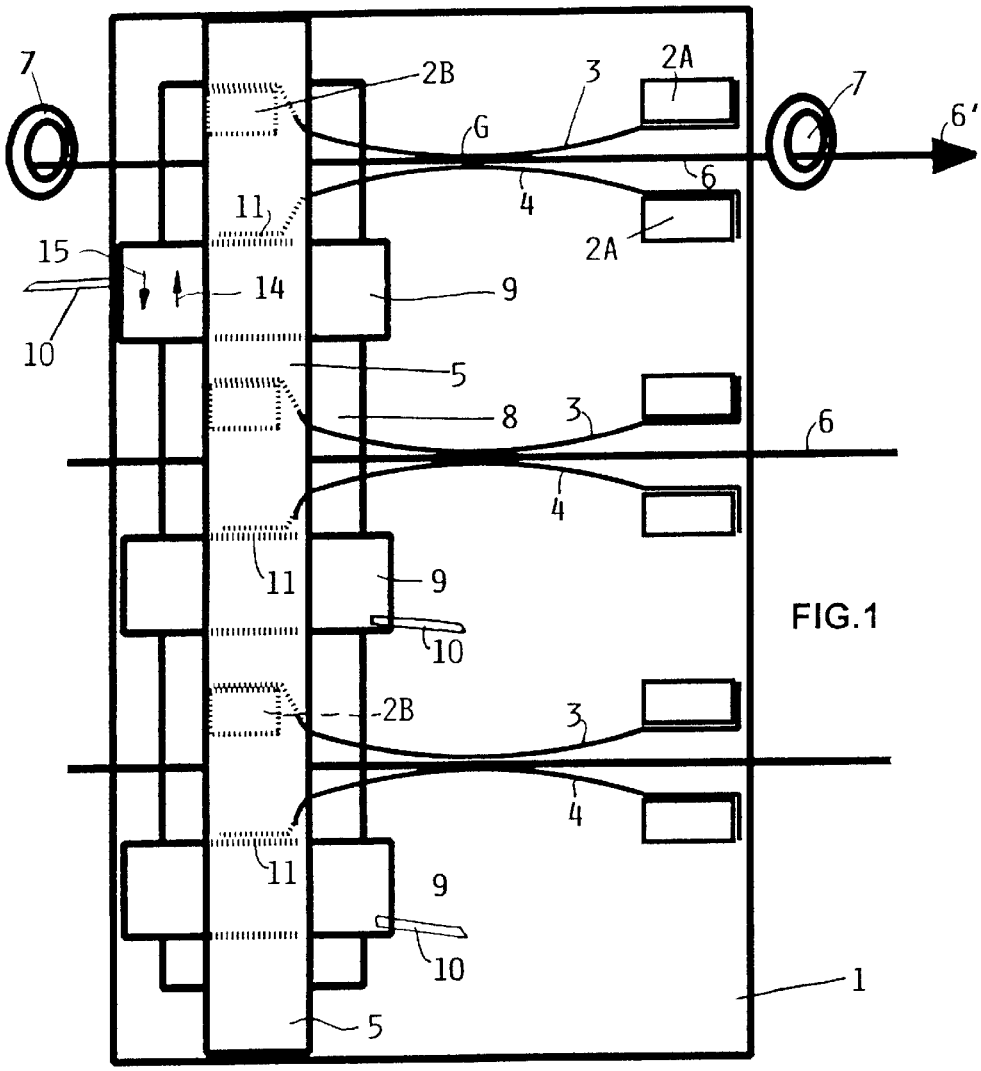
FIG. 1 shows a schematic plan view of a first embodiment of a multi-thread brake according to the invention with three linearly moveable armatures cooperating with a common stator.

FIG. 1 shows a support 1 that may be part of a loom frame or the like. Mountings 2A, 2B are secured to the support 1. Flexible elements 3 and 4 such as lamellae or leaf springs are arranged in pairs and mounted to the mountings 2A and 2B. These flexible elements are preferably curved so that their intermediate sections form a gap G through which a thread 6 guided by thread guides or thread eyes 7 passes from a supply not shown toward the weft insertion as indicated by the arrow head 6'. One of the leaf springs 3 is mounted in a fixed position, while the other leaf spring 4 of a pair is moveably mounted at least with one of its ends. The mountings 2A and 2B are either secured directly to the support 1 or to a mounting bar 5 which in turn is secured to the support 1. As shown, a plurality of leaf springs forming pairs of flexible elements 3, 4 are mounted on the support 1 so that these pairs of flexible elements 3, 4 are arranged side by side in a row or column. As mentioned, the thread, particularly the weft thread 6, is guided through the eyes 7 and through the gap G between the two leaf springs or flexible elements 3 and 4. The thread tension is determined by the force that presses the two leaf springs 3 and 4 against each other, whereby friction is applied to the weft thread to provide a braking action. By adjusting the position of the moveably mounted spring or flexible element 4 it is possible to control the force applied to the fixed leaf spring or flexible element 3 and thus to control the braking action applied to the weft thread 6.

The drive of the moveably mounted leaf spring or flexible element 4 is provided in a preferred manner according to the invention by an electric linear motor comprising an elongated stator 8 on which at least one linearly moveable armature 9 is moveably mounted. The stator 8 carries electrical windings not shown for generating within the stator a magnetic traveling field which induces in the armature or armatures 9 alternating voltages which cause the armature to move along the stator in one or the other direction, depending on the polarization of the magnetic traveling field. The armature 9 is made of electrical conductor material such as copper or aluminum. Rather than providing the stator with the electrical winding, it is possible to provide the armature with the electrical winding so that the stator is the passive element while the armature is the active element.

Figure 2:
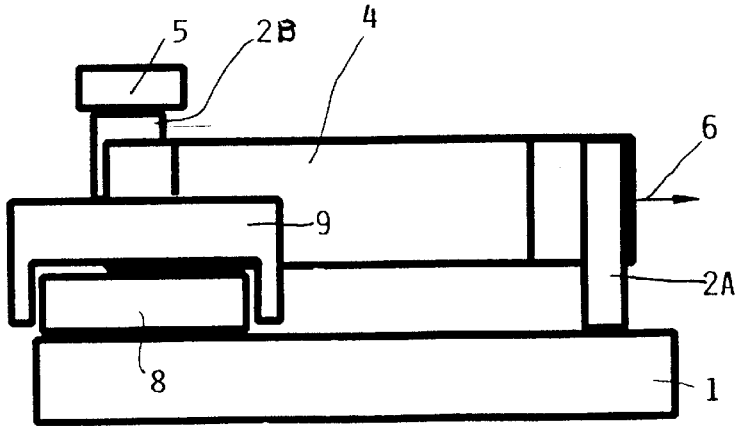
FIG. 2 is a side view of the embodiment of FIG. 1.

In the example embodiment of FIGS. 1 and 2, an elongated stator 8 is mounted in a fixed position on the support 1 in the area of the mountings 2B for the flexible elements or leaf springs 3 and 4. As shown, the stator 8 carries three linearly moveable members such as armatures 9 one of which is provided for each pair of leaf springs or flexible elements 3 and 4. The armatures 9 are preferably formed as slides that are capable to move along the stator 8. The linear motion directions 14, 15 of each armature 9 extend approximately perpendicularly to the moving direction of the weft thread 6. Each armature 9 is provided with an electric winding, not shown, for generating the magnetic traveling field whereby the windings or rather a control forming part of the central loom control is used for individually controlling the windings. The control signals are supplied through a cable 10 which is connected to the central loom control not shown.

The free end 11 of each moveable leaf spring or flexible element 4 is positioned for directly cooperating with the respective armature 9. Depending on the control signal applied to the respective linear motor, the respective armature moves either up as indicated by the arrow 14, or down as indicated by the arrow 15, thereby moving the respective leaf spring 4 toward or away from the other leaf spring 3 of the pair. As a result, the leaf springs 3 and 4 of a pair are pressed toward each other more or less to thereby apply a respectively variable braking action to the weft thread 6.

Figure 3:
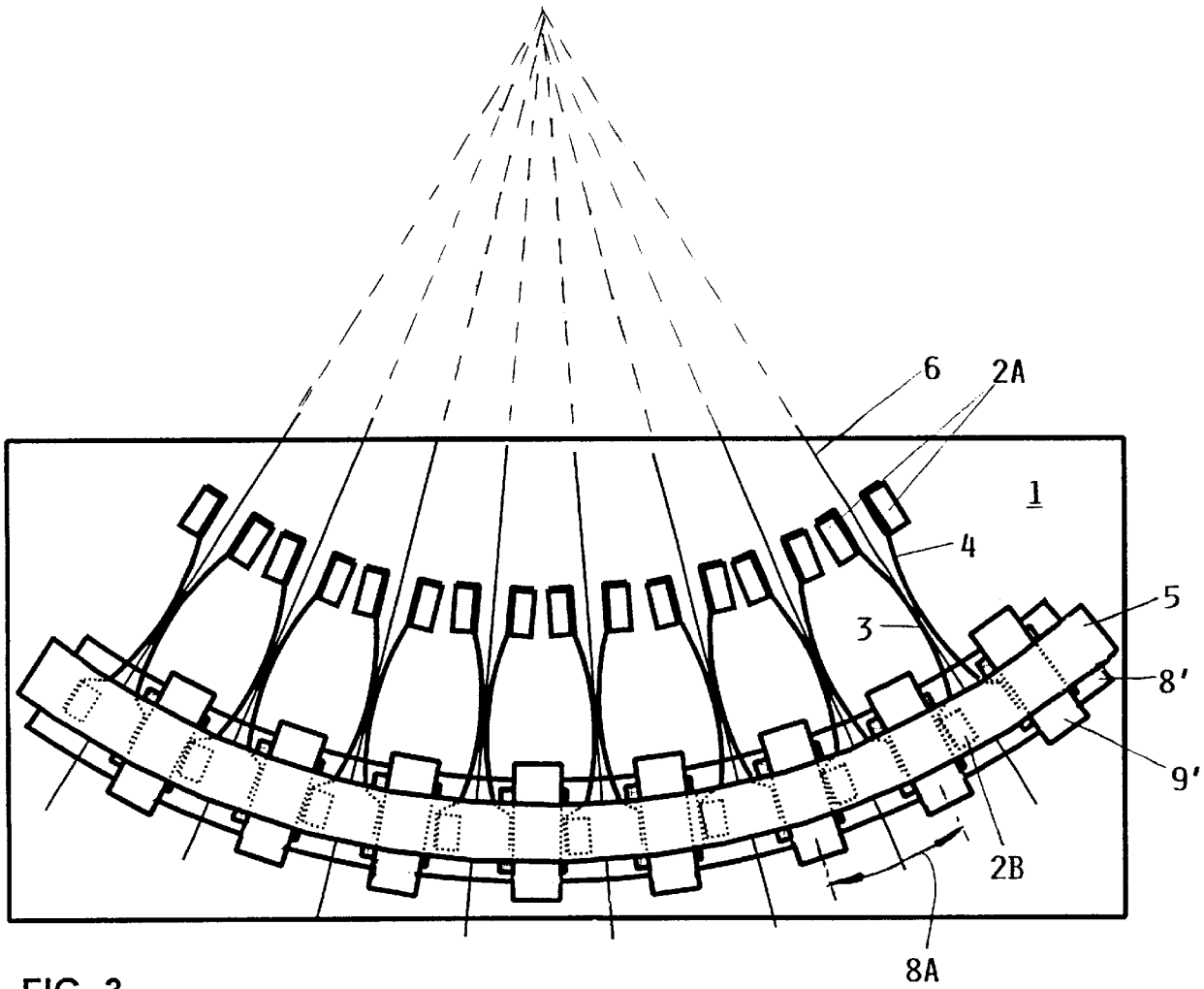
FIG. 3 shows a schematic plan view of a second embodiment, in which the individual linearly moveable members are arranged side by side on a curved support also carrying a single curved stator.
Figure 6:
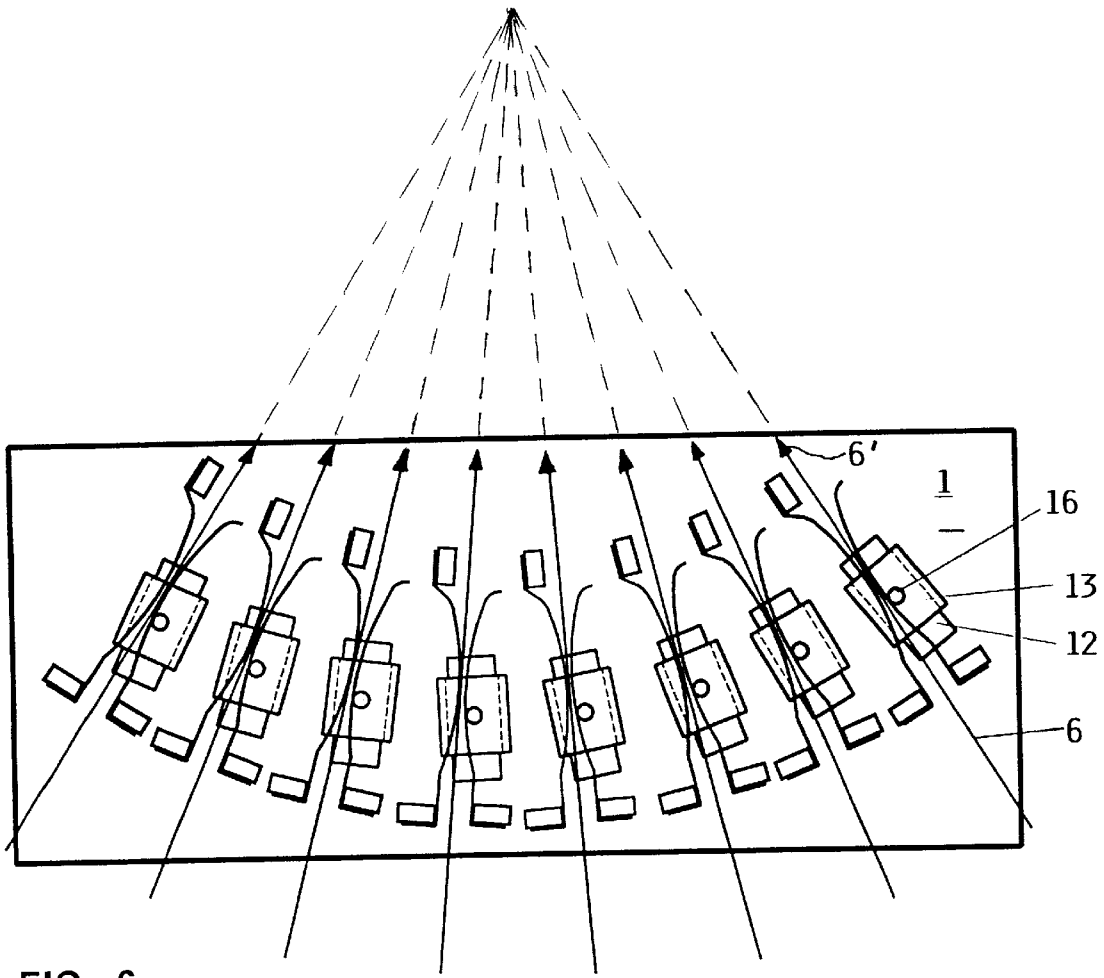
FIG. 6 illustrates a modification of the embodiment of FIG. 4 wherein each linear motor has its own stator and armature arranged in a curved configuration, preferably a circularly curved configuration.

As shown in FIG. 3, a plurality of weft thread brakes may be arranged to form a multi-thread brake comprising, for example, eight such brakes. These brakes are arranged side by side along a curved path, preferably a circular curve. The stator 8' of the linear motor is formed as a single piece having a circular curved configuration. However, individual stators may also be provided for forming, for example, eight individual linear motors as shown in FIG. 6. The stator 8' carries, in the example of FIG. 3, a total of eight linearly moveable armatures 9' which are uniformly distributed and angularly spaced from each other so that each sector 8A holds one armature 9'. The armatures 9' are uniformly distributed with equal on-center spacings among one another along the curved stator 8'. Each of the thread brakes requires but a very small displacement of the respective moveable leaf spring or flexible element 4 so that the arrangement of the armatures 9' along a circular curve does not affect the proper operation of the thread brakes. Further, it is possible and preferable that the minute movement path of each armature 9' is in fact linear if the stator 8' is provided with a straight portion just long enough to accommodate the motion of the respective armature 9'.

The circular configuration of the stator 8' or the circular arrangement of a plurality of stators has the particular advantage of a very compact structure which handles each of the threads gently, because no additional thread guides are required. This is so because the thread brakes already guide the threads toward the center of a circle, where the weft insertion devices such as an air jet is positioned. By avoiding a thread detouring, particularly the threads positioned at an angle relative to the length of a weft insertion channel, the threads are handled carefully.

Figure 4:
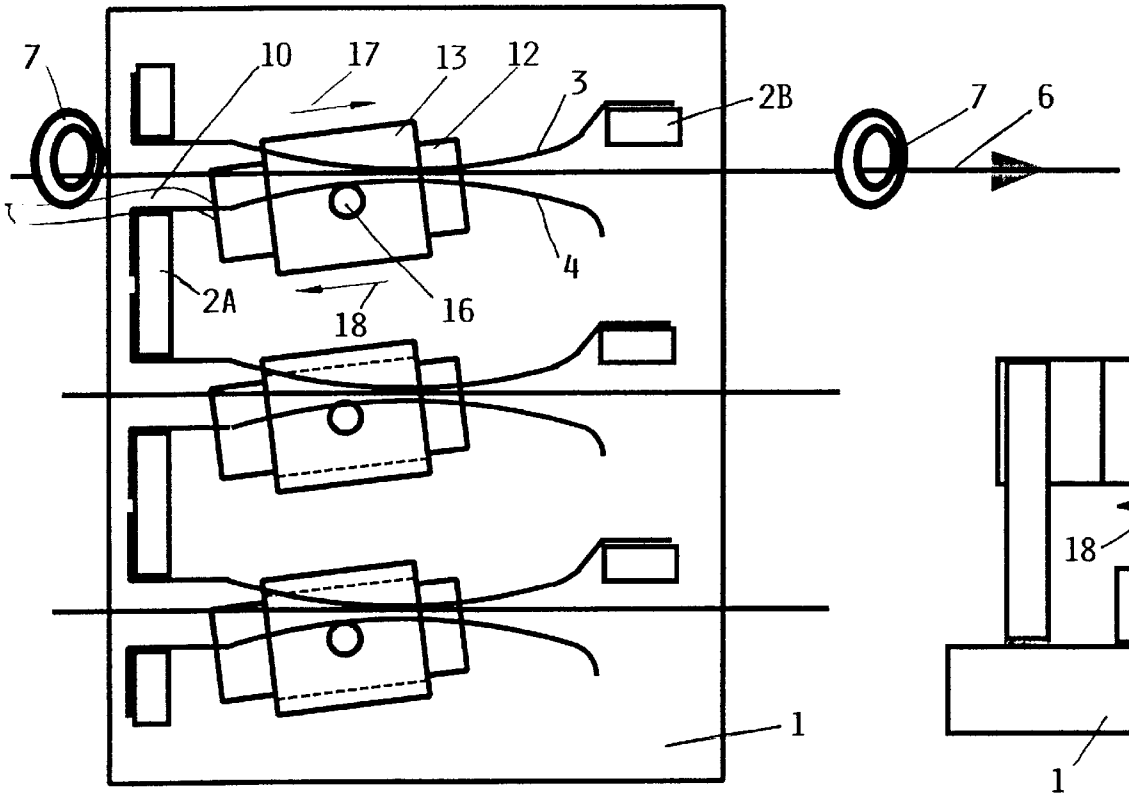
FIG. 4 shows a schematic plan view of a further embodiment of a multi-thread brake according to the invention wherein each brake has its own stator and its own linearly moveable armature.
Figure 5:
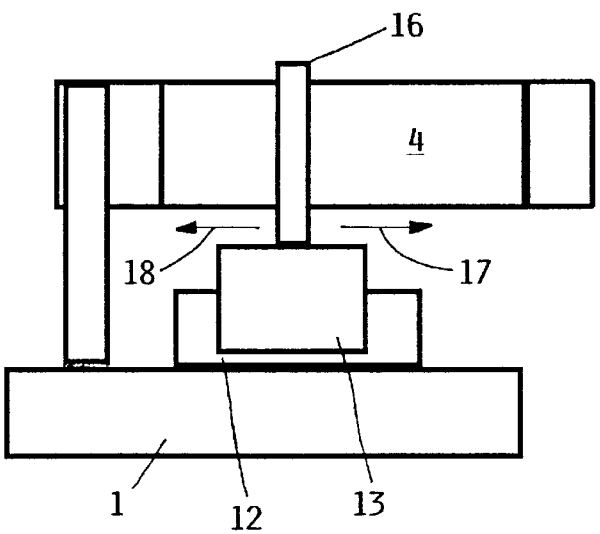
FIG. 5 shows a side view of the embodiment of FIG. 4.

FIGS. 4 and 5 show another embodiment of a weft thread brake according to the invention in which each weft brake is provided with an individual linear motor, each comprising a stator 12 and an armature 13, whereby the linear motors are arranged at an acute angle relative to the movement direction of the weft thread 6. In this embodiment, each stator carries its energizing winding, not shown. Each stator is mounted to the support 1 and the armature is mounted for linear movement on its respective stator 12 without any winding. Each armature 13 carries a thread tension adjustment pin 16 positioned in contact with the respective leaf spring or flexible element 4. The adjustment pin 16 is moved back and forth to the right as indicated by the arrow 17 or to the left as indicated by the arrow 18, thereby sliding along the respective leaf spring or flexible element 4. As a result, the leaf spring or flexible element 4 is pressed against the stationary leaf spring or flexible element 3 of the pair with a larger or smaller force, whereby the weft thread 6 during its insertion into the loom shed can be held under a precise, defined tension that can be adapted to the nature of any particular weft thread.

FIG. 6 shows an embodiment in which individual thread brakes with their individual stators 12 and the individual armature 13 are arranged substantially along a circular path, however, with an acute angle relative to the feed advance direction of the weft threads 6, as also shown in FIG. 4. This arrangement of the linear motors results in a particularly compact construction compared to the embodiment of FIG. 3 because the spacing between neighboring linear motors can be kept optimally small.

The weft thread brakes according to the invention described above realize a basic braking force that depends on the spring constant of the individual leaf springs or flexible elements 3 and 4 and on the basic, adjusted position of the respective armatures or linearly moveable members. This basic position of the armature relative to the respective moveable leaf spring or flexible element 4 is adjusted initially when the loom is set up for operation. The basic braking force can then be controlled by respective control signals from the central loom control, for example, in accordance with a program stored in the memory of the central loom control. Such program contains yarn and pattern related parameters which require respective weft thread tensions. In all embodiments, including the multi-thread brake arrangements, each of the thread brakes is controlled independently of any of the other thread brakes to provide individual braking forces for each weft thread of a group of weft threads.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A thread brake system for weaving looms, said thread brake system comprising a support and a plurality of thread brakes, each thread brake comprising at least one pair of two flexible elements mounted on said support to form a thread gap for passing a thread through said thread gap, and a gap width control comprising an electrical linear motor including a plurality of controllable linearly movable armature members, each linearly movable armature member being positioned for operatively influencing at least one flexible element of each pair of said flexible elements for adjusting said gap width and a respective brake force, and wherein said electrical linear motor comprises a single stator for said plurality of controllable linearly movable armature members so that each said pair of two flexible elements is controlled by a respective armature member of said linearly movable armature members.

2. The thread brake system of claim 1, wherein said electric linear motor is one of a linearly stepping electric motor and a linear electric servo-motor.

3. The thread brake system of claim 1, wherein said plurality of controllable linearly movable armature members are positioned for directly influencing said at least one flexible element.

4. The thread brake system of claim 1, further comprising an adjustment member 16 connected to at least one controllable linearly movable armature member of said plurality of said armature members and positioned in contact with said at least one flexible element.

5. The thread brake system of claim 1, wherein said electrical linear motor is adapted for connection to a central loom control for controlling a linear motion of said controllable linearly movable armature members through said central loom control.

6. The thread brake system of claim 1, wherein said single stator is an elongated structural component arranged in common for all of said plurality of controllable linearly movable armature members arranged side by side along a straight line.

7. The thread brake system of claim 1, wherein said single stator is a curved structural component arranged in common for all of said plurality of controllable linearly movable armature members and positioned along a curve corresponding to said curved structural component.

8. The thread brake system of claim 1, wherein said single stator forms with said plurality of controllable linearly movable armature members a corresponding plurality of controllable linear motors, and wherein said controllable linear motors are adapted for connection to a central loom control for controlling a linear motion of all of said controllable linear motors through said central loom control.

9. The thread brake system of claim 7, wherein said plurality of controllable linearly movable armature members are arranged side by side along a portion of a circle circumference.

* * * * *